US011208291B2

(12) United States Patent
Terao et al.

(10) Patent No.: US 11,208,291 B2
(45) Date of Patent: Dec. 28, 2021

(54) POST-PROCESSING APPARATUS AND IMAGE FORMING APPARATUS SYSTEM

(71) Applicant: TOSHIBA TEC KABUSHIKI KAISHA, Tokyo (JP)

(72) Inventors: Yasunobu Terao, Izunokuni Shizuoka (JP); Yoshiaki Sugizaki, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/921,845

(22) Filed: Jul. 6, 2020

(65) Prior Publication Data

US 2021/0087013 A1 Mar. 25, 2021

(30) Foreign Application Priority Data

Sep. 20, 2019 (JP) ..... JP2019-171444

(51) Int. Cl.
*B65H 43/08* (2006.01)
*B65H 37/04* (2006.01)

(52) U.S. Cl.
CPC ..... *B65H 43/08* (2013.01); *B65H 37/04* (2013.01)

(58) Field of Classification Search
CPC ..... B65H 43/00; B65H 43/06; B65H 43/08; B65H 37/04; B65H 7/02; B65H 7/06; B65H 7/14; B65H 7/20; B65H 2553/412; B65H 2553/414; B65H 2553/80; B65H 2553/82; B65H 2801/27
USPC ..... 271/258.01; 270/58.02
See application file for complete search history.

(56) References Cited

U.S. PATENT DOCUMENTS 5,614,987 A * 3/1997 Nishioka ..... G03D 15/005 355/18
7,344,130 B2 * 3/2008 Kamiya ..... B65H 45/18 270/32
7,407,156 B2 * 8/2008 Iizuka ..... B65H 31/24 270/58.11

(Continued)

FOREIGN PATENT DOCUMENTS

JP 2004043037 A 2/2004
JP 2007-145550 A 6/2007
JP 2016060596 A 4/2016

OTHER PUBLICATIONS

Extended European Search Report dated Feb. 10, 2021, mailed in counterpart European Application No. 20195496.3, 9 pages.

*Primary Examiner* — Leslie A Nicholson, III
(74) *Attorney, Agent, or Firm* — Kim & Stewart LLP

(57) ABSTRACT

A post-processing apparatus includes a post-processing unit configured to receive sheets from an image forming apparatus, perform processing on the received sheets, and then discharge the processed sheets through a discharge port. A sensor is configured to detect a presence of an object at the discharge port. The sensor includes a first light emitter on a first side of the discharge port that is positioned to emit a light across a width of the discharge port, a reflector on a second side of the discharge port opposite the first side in a first direction, and a first light receiver positioned to receive light of the first light emitter from the reflector. A controller is configured to terminate the processing on the received sheets by the post-processing unit when the sensor detects the presence of the object at the discharge port.

18 Claims, 13 Drawing Sheets

(56) References Cited

U.S. PATENT DOCUMENTS

| | | | | |
|---|---|---|---|---|
| 7,654,525 | B2 * | 2/2010 | Wang | B65H 7/14 271/265.01 |
| 8,109,497 | B2 * | 2/2012 | Okamoto | B65H 45/18 270/58.14 |
| 8,226,079 | B2 * | 7/2012 | Ozawa | B65H 31/34 270/58.09 |
| 8,246,034 | B2 * | 8/2012 | Tsuchiya | B65H 31/3081 270/58.12 |
| 11,022,925 | B2 | 6/2021 | Yamamoto et al. | |
| 11,065,904 | B2 | 7/2021 | Dobashi et al. | |
| 2020/0130977 | A1 * | 4/2020 | Miyazaki | B65H 29/125 |

* cited by examiner

POST-PROCESSING APPARATUS AND IMAGE FORMING APPARATUS SYSTEM

CROSS-REFERENCE TO RELATED APPLICATIONS

This application is based upon and claims the benefit of priority from Japanese Patent Application No. 2019-171444, filed on Sep. 20, 2019, the entire contents of which are incorporated herein by reference.

FIELD

Embodiments described herein relate generally to a post-processing apparatus and an image forming apparatus system.

BACKGROUND

There is an image forming apparatus that performs post-processing, such as stapling, after an image has been formed on a sheet. Such an image forming apparatus can be provided with a space in which a unit for performing the post-processing can be installed. Since the sheet after the post-processing execution must be discharged, the unit for executing the post-processing is connected to the outside of the apparatus through a discharge port. The unit (including the discharge port) may be pulled from the apparatus after the execution of the post-processing has been completed. A means for arranging a sensor having a light-emitting unit and a light-receiving unit in order to detect foreign substances or objects in the space has been proposed. However, there can be cases where a foreign object such as a hand of a user cannot be detected due to reflected light from a sheet or the like in the space.

DETAILED DESCRIPTION

It is an object of the present invention to provide a post-processing apparatus and an image forming system capable of suppressing occurrence of erroneous detection due to reflected light of a sheet and while also detecting an object at a discharge port with high accuracy.

According to one embodiment, a post-processing apparatus includes a post-processing unit configured to receive sheets from an image forming apparatus, perform processing on the received sheets, and then discharge the processed sheets through a discharge port. A sensor is configured to detect a presence of an object (e.g., a user's hand or portion thereof) at the discharge port. The sensor includes a light emitter on a first side of the discharge port. The light emitter is positioned to emit a light across a width of the discharge port. The sensor further includes a reflector on a second side of the discharge port opposite the first side in a first direction and a first light receiver that is positioned to receive light of the light emitter from the reflector. A controller is configured to terminate the processing on the received sheets by the post-processing unit when the sensor detects the presence of the object at the discharge port.

Hereinafter, a post-processing apparatus and an image forming system according to an embodiment will be described with reference to the drawings.

Figure 1:
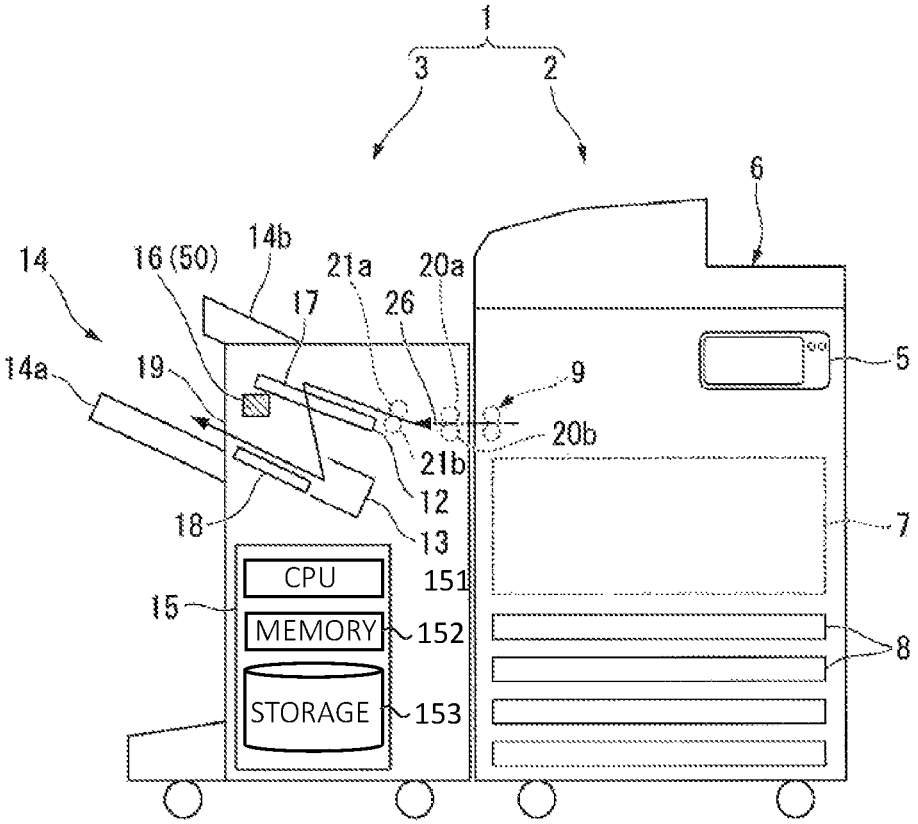
FIG. 1 is a schematic side view illustrating an example of a hardware configuration of an image forming system according to an embodiment.

An image forming system 1 according to an embodiment will be described with reference to FIGS. 1 to 3. FIG. 1 is a schematic side view illustrating an example of a hardware configuration of the image forming system 1 according to the embodiment.

Figure 2:
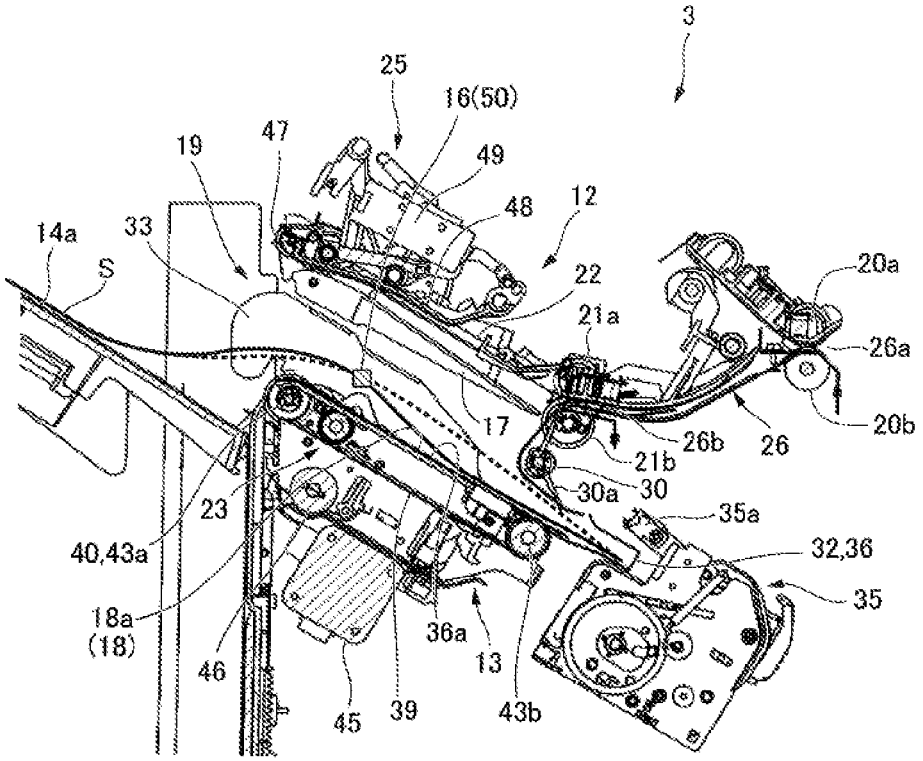
FIG. 2 is a side view illustrating an example of a hardware configuration of a post-processing apparatus of an embodiment.

FIG. 2 is a side view illustrating an example of a hardware configuration of a post-processing apparatus 3 according to the embodiment.

Figure 3:
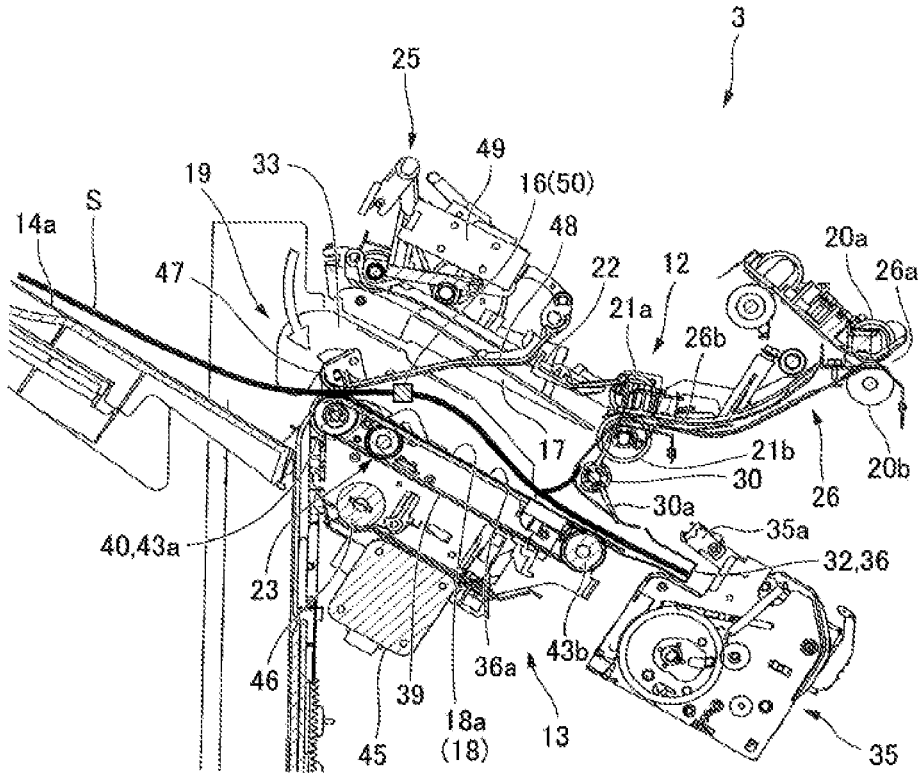
FIG. 3 is a side view illustrating an example of a pinch roller in a pivot position facing a vertical alignment roller in an embodiment

FIG. 3 is a side view illustrating an example of a pinch roller 47 in a pivot position facing a vertical alignment roller 40 in the embodiment.

As shown in FIG. 1, the image forming system 1 includes an image forming apparatus 2 and a post-processing apparatus 3. The image forming apparatus 2 may be referred to as a multifunctional peripheral (MFP) apparatus. The image forming apparatus 2 forms an image on a sheet-like recording medium (hereinafter referred to as a "sheet S"), such as a sheet of paper. The post-processing apparatus 3 performs post-processing on the sheets S conveyed from the image forming apparatus 2. The "post-processing" in this context may be any processing that is performed after the image forming (printing) on the sheet S by the image forming apparatus 2. For example, the post-processing may be stapling processing. Hereinafter, a stapling process will be described as a particular, non-limiting example of post-processing. A bundle or other grouping of stacked sheets S will be referred to as a sheet bundle SS.

The image forming apparatus 2 includes a processor, a memory, an auxiliary storage, and the like connected by a bus, and executes a program. The image forming apparatus 2 includes a control panel 5, a scanner unit 6, a printer unit 7, a sheet feed unit 8, and a sheet discharge unit 9.

The control panel 5 includes various keys, a touch panel, and the like that accept a user input operation. The control panel 5 receives input relating to a type of the post-processing of the sheet(s) S. Information on the type of post-processing input by the control panel 5 is sent to the post-processing apparatus 3.

The scanner unit 6 includes a reading unit that reads image information of a document or the like. The scanner unit 6 transmits the read image information to the printer unit 7. The printer unit 7 forms an image with a developer, such as toner, based on the image information (data) transmitted from the scanner unit 6 or an external device. The printer unit 7 applies heat and pressure to the toner image that has been transferred to the sheet S, thereby fixing the toner image to the sheet S. The sheet feed unit 8 supplies the sheets S one by one to the printer unit 7 in accordance with the timing at which the printer unit 7 forms the toner image. The sheet discharge unit 9 conveys the sheets S discharged from the printer unit 7 to the post-processing apparatus 3.

Next, the post-processing apparatus 3 will be described.

As shown in FIG. 1, the post-processing apparatus 3 is located adjacent to the image forming apparatus 2. The post-processing apparatus 3 executes the particular post-processing (designated through the control panel 5) on the printed sheet S conveyed from the image forming apparatus 2. The post-processing apparatus 3 includes a processor 151, a memory 152, a storage unit 153, and the like connected by a bus, and executes a program.

As shown in FIGS. 2 and 3, the post-processing apparatus includes a standby unit 12, a processing unit 13, a discharge unit 14, a post-processing controller 15, a sensor (including a sensor transmitter 16-1, and a sensor receiver 16-2).

The standby unit 12 temporarily holds (buffers) the sheet (s) S conveyed from the image forming apparatus 2. The standby unit 12 includes a standby tray 17. For example, while the post-processing of a preceding sheet S is being performed by the processing unit 13, the standby unit 12 causes the succeeding sheets S to wait. The standby unit 12 is disposed above the processing unit 13. For example, the standby unit 12 causes the sheets S to be stacked while waiting. When the processing unit 13 is empty, the standby unit 12 causes the previously retained sheet S to fall toward the processing unit 13.

The processing unit 13 includes a processing tray 18 for receiving the sheet S dropped from the standby unit 12. The processing unit 13 executes post-processing on the conveyed sheet S. The processing unit 13 executes post-processing on the sheet bundle SS in which a plurality of sheets S are aligned. For example, the post-processing executed by the processing unit 13 is a binding processing (stapling processing) performed by a stapler 35. The processing unit 13 discharges the sheet(s) S that have been subjected to the post-processing to the discharge unit 14.

As shown in FIG. 1, the discharge unit 14 includes a movable tray 14*a* and a fixed tray 14*b*. The movable tray 14*a* is provided on a side of the post-processing apparatus 3, and is capable of discharging the sheet S from the processing unit 13. The movable tray 14*a* is movable in an up-down direction along the side of the post-processing apparatus 3. The fixed tray 14*b* is provided on an upper portion of the post-processing apparatus 3. For example, it is possible to appropriately discharge the sheet S from the standby unit 12 to the fixed tray 14*b*.

The discharge unit 14 includes a discharge port for discharging the sheets S to any movable trays 14*a* or fixed trays 14*b* outside of the apparatus main body of the post-processing apparatus 3. The sensor 16 of an object detection device 50 is provided in a discharge port 19 for the movable tray 14*a*.

The post-processing controller 15 controls overall operation of the post-processing apparatus 3. The post-processing controller 15 includes a control circuit including a processor 151, a memory 152, and a storage unit 153. The post-processing controller 15 controls operation of each functional unit of the post-processing apparatus 3. For example, the post-processing controller 15 controls the standby unit 12, the processing unit 13, and the discharge unit 14. The post-processing controller 15 controls the operation of inlet rollers 20*a* and 20*b* and outlet rollers 21*a* and 21*b*. The inlet rollers 20*a* and 20*b* and the outlet rollers 21*a* and 21*b* cause the sheet S to be conveyed to the standby tray 17.

Herein, an "upstream side" and a "downstream side" in the present context refers to an upstream side (that is, the image forming apparatus 2 side) and a downstream side (that is, the discharge unit 14 side) along a conveyance direction of the sheet S, respectively, through the post-processing apparatus 3. A "front end portion" and a "rear end portion" in this context refer to the "downstream end portion" and the "upstream end portion" in the sheet conveyance direction, respectively. In the present disclosure, a direction parallel to a plane of the sheet S (sheet surface direction) and perpendicular to the sheet conveyance direction is referred to as a width direction W.

As shown in FIGS. 2 and 3, the post-processing apparatus 3 includes a conveyor unit 26 that conveys or otherwise moves the sheet S after passing the sheet discharge unit 9 of the image forming apparatus 2. The conveyor unit 26 includes a sheet supply port 26*a* provided with a pair of inlet rollers 20*a* and 20*b*, and a sheet discharge port 26*b* provided with a pair of outlet rollers 21*a* and 21*b*. The sheet supply port 26*a* faces the sheet discharge unit 9 of the image forming apparatus 2. The sheet S is thusly supplied from the image forming apparatus 2 to the sheet supply port 26*a*. The seat discharge port 26*b* faces the standby unit 12. The sheet S passing through the conveyor unit 26 is conveyed from the sheet discharge port 26*b* to the standby unit 12.

The standby unit 12 includes a standby tray 17 (also referred to as a buffer tray 17) and an assist guide 22. The rear end portion of the standby tray 17 is located in the vicinity of the outlet rollers 21*a* and 21*b*. The rear end portion of the standby tray 17 is located lower than the sheet discharge port 26*b* of the conveyor unit 26. The standby tray 17 is inclined with respect to the horizontal direction so as to gradually increase in height toward its downstream side end in the sheet conveyance direction. The standby tray 17 holds sheets S while the processing unit 13 performs the post-processing.

The standby tray 17 has a pair of tray members that can be moved closer to and away from each other in the width direction W. In the case where the sheet S stands by in the standby tray 17, the pair of tray members can be brought close to each other to support the sheet S. When moving the sheet S from the standby tray 17 toward the processing tray 18 of the processing unit 13, the pair of tray members are separated from each other. Accordingly, the standby tray 17 causes the supported sheet S to fall (move) toward the processing tray 18.

A paddle portion 30 is provided between the upstream side of the standby tray 17 and the upstream side of the processing tray 18. The paddle portion 30 rotates about a rotation axis along the width direction W, thereby pressing the sheet S toward the processing tray 18. The paddle portion 30 presses the rear end portion of the sheet S toward the processing tray 18 when the sheet S moves from the standby tray 17 toward the processing tray 18. The paddle portion 30 has a paddle 30*a* formed of an elastic material such as rubber, and the rear end portion of the sheet S is pressed to the processing tray 18 by the paddle 30*a*.

The processing unit 13 includes a processing tray 18, a horizontal alignment plate 33, a rear end stopper 32, a stapler 35 (also referred to as binding processing unit), an ejector 36, a thruster 36*a*, a bundle claw belt 39, a vertical alignment roller 40 (also referred to as a conveyance roller), and belt pulleys 43*a* and 43*b*.

The processing tray 18 is provided below the standby tray 17. The processing tray 18 is inclined with respect to the horizontal direction so as to gradually increase in the direction toward the downstream end side in the sheet conveyance direction. The processing tray 18 is inclined, for example, to parallel the standby tray 17. The processing tray 18 has a conveyance surface 18*a* that supports the sheet S (that is, the sheet S can be placed thereon).

A pair of horizontal alignment plates 33 are provided facing each other on both sides in the width direction W of the conveyance surface 18*a* of the processing tray 18. The pair of horizontal alignment plates 33 are provided to be spaced apart from each other in the width direction W. The horizontal alignment plate 33 is movable in the width direction W in a direction approaching each other and a direction separating from each other. The horizontal alignment plate 33 constitutes a horizontal alignment device that performs alignment of the sheet S in the width direction W (so-called horizontal alignment).

The rear end stopper 32 is provided at an upstream end portion of the processing tray 18. The sheet S placed on the processing tray 18 is conveyed toward the rear end stopper 32 by the vertical alignment roller 40 being reversibly driven in the clockwise direction in the figure. The vertical alignment roller 40 cooperates with the paddle portion 30 to bring the upstream end of the sheet S into contact with the rear end stopper 32, thereby performing longitudinal alignment of the sheet S. The vertical alignment roller 40 forwardly rotates in the counterclockwise direction in the figure, thereby bending or flexing the sheet S in cooperation with the paddle portion 30 that presses the rear end portion of the sheet S.

The stapler 35 is disposed at the rear of the processing tray 18. The stapler 35 includes a staple clinch 35*a*. The stapler 35 can bind the aligned ends of the sheet S in contact with the rear end stopper 32. The stapler 35 performs stapling processing on the end of the sheet bundle SS, which is aligned with the rear end stopper 32, with the staple clinch 35*a*. The stapler 35 is capable of moving within a prescribed range so as to staple the sheet bundle SS at the position indicated by a user via the control panel.

The ejector 36 is provided at the initial position of an upstream end portion of the processing tray 18. The ejector 36 is provided so as to overlap the rear end stopper 32. The ejector 36 is capable of moving the sheet S toward the downstream side in the conveyance direction. When the ejector 36 moves toward the downstream side in the conveyance direction, the ejector 30 advances the sheet bundle SS on which the post-processing has been performed. The ejector 36 is disposed at a position at which the end portion of the sheet bundle SS can be delivered to a bundle claw. The ejector 36 is biased toward the initial position before movement.

The bundle claw belt 39 includes a bundle claw (an extrusion member). The bundle claw belt 39 spans the pair of belt pulleys 43*a* and 43*b* located on the upstream side and the downstream side in the conveyance direction of the processing tray 18. The bundle claw belt 39 and the belt pulleys 43*a* and 43*b* constitute a bundle claw drive mechanism for driving the bundle claw. The bundle claw drive mechanism 23 includes a bundle claw drive motor 45 as a drive source shared by the bundle claw, the ejector 36, and the thruster 36*a*. The bundle claw drive motor 45 is always connected to the belt pulley 43*a*, but is disconnectable and connectable to the ejector 36 and the thruster 36*a* via an electromagnetic clutch 46.

When the belt pulley 43*a* is driven in the counterclockwise direction in the figure, the bundle claw, ejector 36, and thruster 36*a* move from the upstream side in the conveyance direction to the downstream side (the left side in the figure) on the conveyance surface 18*a* of the processing tray 18. When the belt pulley 43*a* is driven in the clockwise direction in the figure, the bundle claw, ejector 36, and thruster 36*a* move on the conveyance surface 18*a* of the processing tray 18 toward the upstream side in the conveyance direction (the right side in the figure).

The vertical alignment roller 40 forwardly rotates in the counterclockwise direction in the figure, thereby transporting the sheet S placed in the processing tray 18 toward the movable tray 14*a* of the discharge unit 14. The vertical alignment roller 40 applies a driving force to the sheet S by coming into contact with the sheet S placed in the processing tray 18 from below. As illustrated in FIG. 2, when the sheet S on the processing tray 18 is bent and separated from the vertical alignment roller 40, the driving force of the vertical alignment roller 40 cannot be applied to the sheet S. Therefore, a pinch roller 47 for sandwiching the sheet S between the processing tray 18 and the vertical alignment roller 40 is provided as a pressing roller above the processing tray 18 (which is also above the standby tray 17 in the embodiment).

The pinch roller 47 is a driven roller. The pinch roller 47 is movable between a standby position located above the standby tray 17 (see FIG. 2) and a pivot position facing the vertical alignment roller 40 (see FIG. 3). The pinch roller 47 is driven by the roller drive mechanism 25 so as to move between the standby position and the pivot position. The pinch roller 47 is pushed toward the vertical alignment roller 40 by being moved (lowered) to the downward rotation position, and the sheet S is sandwiched between the pinch roller 42 and the vertical alignment roller 40. This makes it possible to stably transmit the driving force of the vertical alignment roller 40 to the sheet S.

The drive mechanism 25 has a support arm 48 that supports the pinch roller 47 at a distal end portion (front end portion) and is swingable about an axis along which a proximal end portion (rear end portion) is along the width direction W. A solenoid 49 is connected to the proximal end portion of the support arm 48. As shown in FIG. 2, when the solenoid 49 is driven to cause a plunger to protrude, the support arm 48 swings upward about the axis. As the support arm 48 swings, the pinch roller 47 swings upward and moves to the standby position. As shown in FIG. 3, when the solenoid 49 is immersed in the plunger, the support arm 48 swings downward around the axis. With the swinging of the support arm 48, the pinch roller 47 swings downward via the support arm 48 and moves to the pivot position. The pinch roller 47 is pressed toward the vertical alignment roller 40 in the pivot position.

The post-processing controller 15 illustrated in FIG. 1 determines an operation mode of the image forming system 1. Specifically, when the automatic processing mode is selected in the control panel 5, the post-processing controller 15 determines that the operation mode of the post-processing apparatus 3 is an automatic post-processing mode. When a manual operation mode is selected in the control panel 5, the post-processing controller 15 determines that the operation mode of the post-processing apparatus 3 is the manual operation mode. The post-processing controller 15 acquires sensor information acquired by the sensor 16.

The post-processing controller 15 instructs the pinch roller 47 to raise or lower the pinch roller 47. When the pinch roller 47 is raised in response to an instruction for raising, a substantial opening area of the discharge port 19 that allows the post-processing interior space and the space outside the apparatus to communicate with each other is widened. The opening area provided when the pinch roller 47 is in its most raised position is typically large enough for a person's hand to enter the post-processing space. When the pinch roller 47 is lowered upon receiving an instruction for lowering, the once substantial opening area of the discharge port 19 becomes narrow. For example, when the pinch roller is in its lowest position, the discharge port 19 is substantially closed off and prevents an external object (foreign object) B from entering the post-processing space.

The post-processing controller 15 instructs the processing unit 13 to execute matching processing. The matching processing is a process for aligning positions of the end portions in the width direction and the end portions in the length direction of the plurality of sheets S. When the processing unit 13 performs the matching processing, the horizontal alignment plate 33 and the vertical alignment roller 40 operate to align the positions of the end portions in the width direction and the length direction of the plurality of sheets S. The length direction of the sheet S refers to a direction along the sheet conveyance direction in the sheet surface direction.

The post-processing controller 15 instructs the stapler 35 to execute post-processing. The stapler 35, which has received an instruction to perform the post-processing, executes post-processing on the sheet bundle SS.

The post-processing controller 15 instructs the ejector 36 to execute sheet discharge processing. The ejector 36, which has received an instruction to execute the sheet discharge processing, discharges the sheet bundle on which the post-processing has been executed to the outside of the post-processing apparatus 3.

Next, an object detection apparatus 50 will be described.

Figure 4:
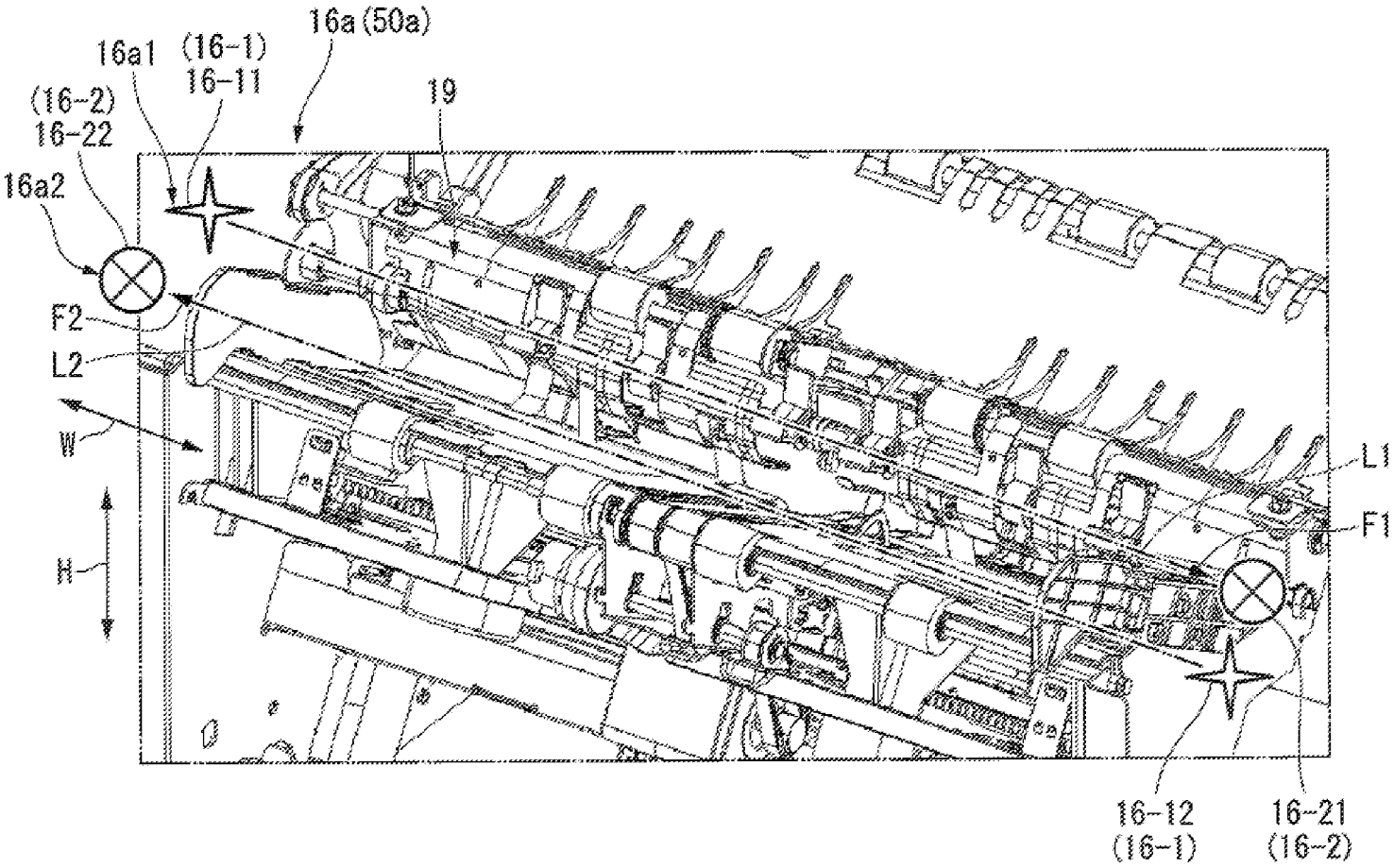
FIG. 4 is a perspective view illustrating an arrangement of a sensor transmitter and a sensor receiver of an object detection apparatus according to a comparative example.
Figure 5:
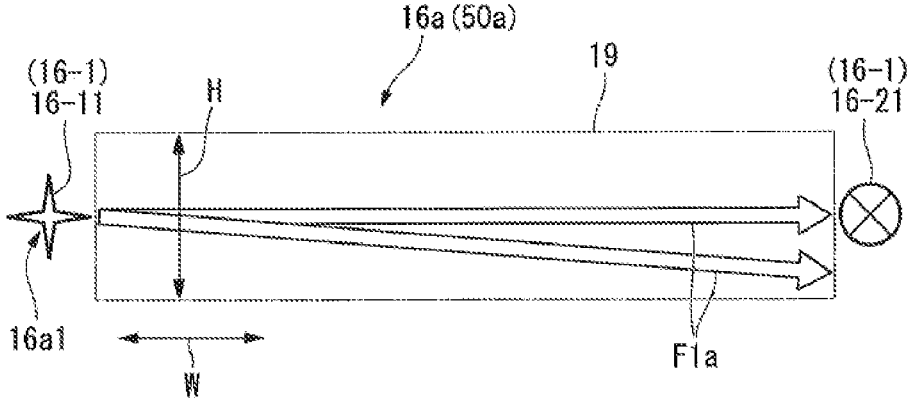
FIG. 5 is an explanatory diagram illustrating a first action of a sensor transmitter and a sensor receiver of an object detection apparatus according to a comparative example.
Figure 6:
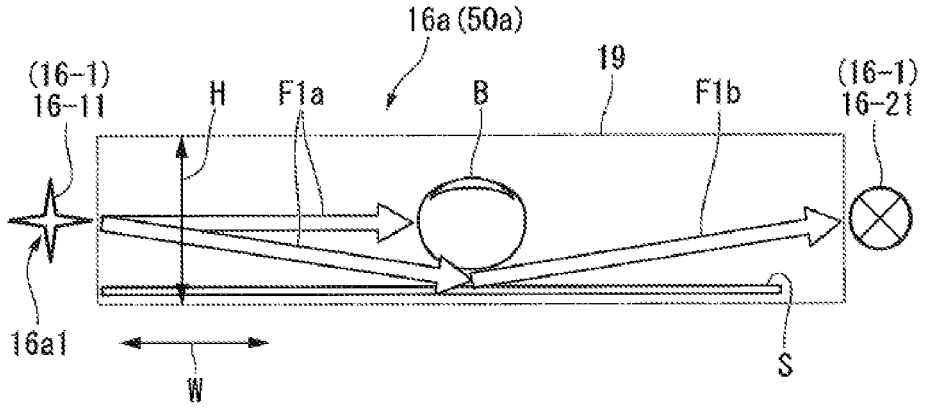
FIG. 6 is an explanatory diagram illustrating a second action of a sensor transmitter and a sensor receiver of an object detection apparatus of a comparative example.

FIG. 4 is a perspective view illustrating an arrangement of a sensor transmitter 16-1 and a sensor receiver 16-2 in an object detection apparatus 50*a* according to a comparative example. FIG. 5 is an explanatory diagram illustrating a first action of the sensor transmitter 16-1 and the sensor receiver unit 16-2 in the object detection apparatus 50*a* of the comparative example. FIG. 6 is an explanatory diagram illustrating a second operation of the sensor transmitter 16-1 and the sensor receiver unit 16-2 in the object detection apparatus 50*a* according to the comparative example.

As shown in FIG. 4, the sensor transmitter 16-1 and the sensor receiver 16-2 form a transmission type sensor 16*a* in pairs. In the comparative example, the object detection apparatus 50*a* includes a pair of sensors 16*a*1 and 16*a*2. Hereinafter, the pair of sensors 16*a*1 and 16*a*2 will be referred to as a first sensor 16*a*1 and a second sensor 16*a*2. In this context, the sensor transmitter 16-1 of sensor 16*a*1 is denoted by the reference numeral 16-11 and the sensor transmitter 16-1 of the sensor 16*a*2 is denoted by the reference numeral 16-12. Furthermore, the sensor receiver 16-2 of the first sensor 16*a*1 is denoted by the reference numeral 16-21, and the sensor receiver 16-2 of the first sensor 16*a*2 is denoted by the reference numeral 16-22.

Each of the sensors 16*a*1 and 16*a*2 positions the respective sensor transmitter 16-1 and the sensor receiver 16-2 to opposite sides of the discharge port 19 in the width direction W. The arrows F1 and F2 in the figure indicate detection light emitted from the sensor transmitter 16-11 and 16-12 respectively. Each detection light F1 and F2 is emitted along the width direction W at the discharge port 19.

In the comparative example, the first sensor 16*a*1 is disposed on the upper portion of the discharge port 19, and the second sensor 16*a*2 is disposed on the lower portion of the discharge port 19. Thereby, it is possible to detect the object B in a wide range in the height direction (vertical direction H) of the discharge port 19.

The first sensor 16*a*1 and the second sensor 16*a*2 are configured such that the arrangement of the sensor transmitter 16-1 and the sensor receiver 16-2 is opposite to each other in the width direction W. Accordingly, the detection light of from sensor transmitters 16-1 of the first sensor 16*a*1 and the second sensor 16*a*2 is not detected by the sensor receiver 16-2 of the other one of the first sensor 16*a*1 and the second sensor 16*a*2.

FIGS. 5 and 6 illustrate the operation of the first sensor 16*a*1, but the second sensor 16*a*2 operates with a similar a symmetrical effect in the width direction W.

As shown in FIGS. 5 and 6, in the object detection apparatus 50*a* of the comparative example, when the object B having a size of a finger is present in the approximate center of the width direction W of the discharge port 19, the object B may not be properly detected. This occurs when a direct light (arrow F1*a*) from the sensor transmitter is blocked by the object B, and a reflected light (arrow F1*b*), reflected by the sheet S passing through the discharge port 19, reaches the sensor receiver 16-21 while avoiding the object B.

Figure 7:
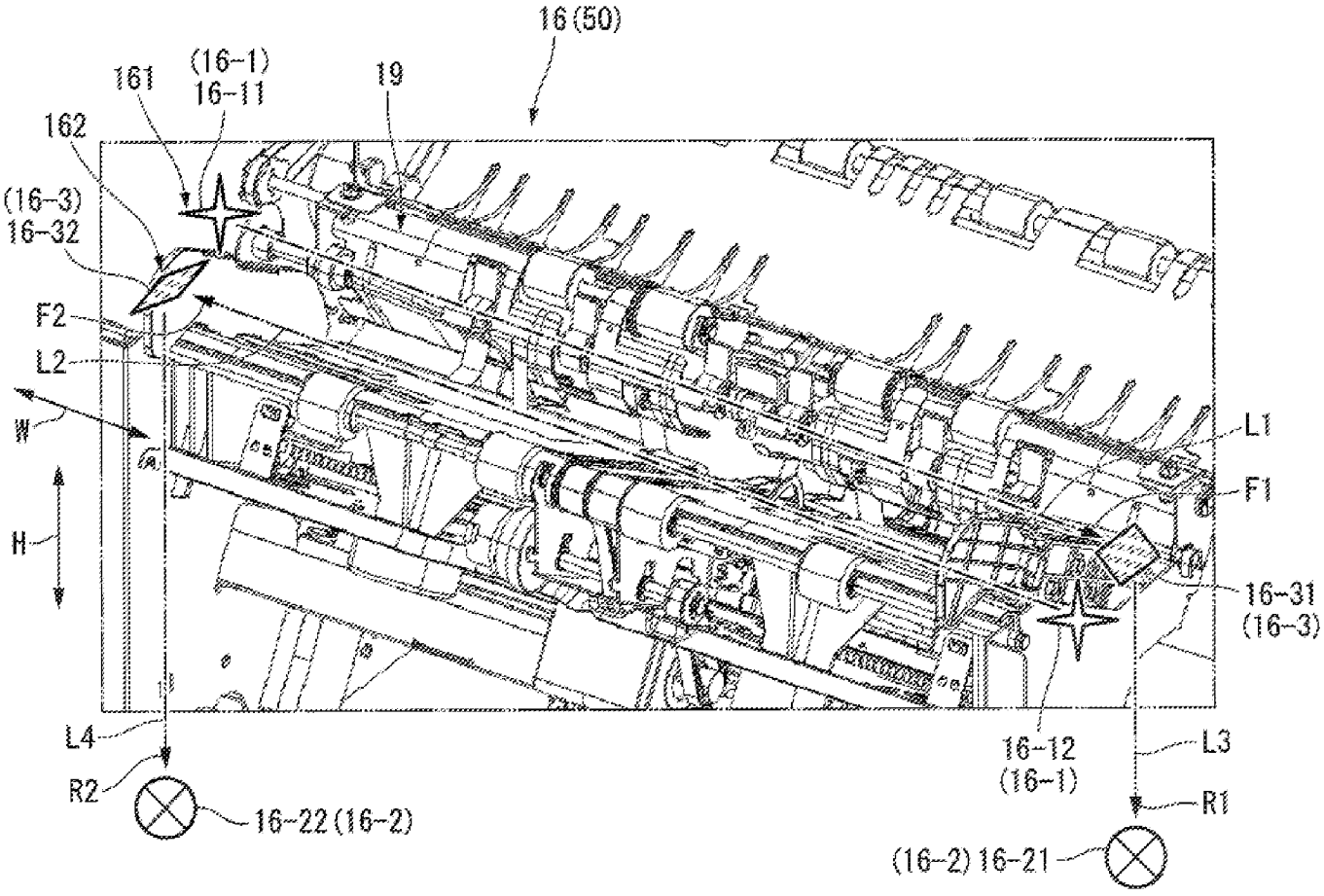
FIG. 7 is a perspective view illustrating an arrangement of a sensor transmitter, a reflector, and a sensor receiver of an object detection apparatus according to an embodiment.
Figure 8:
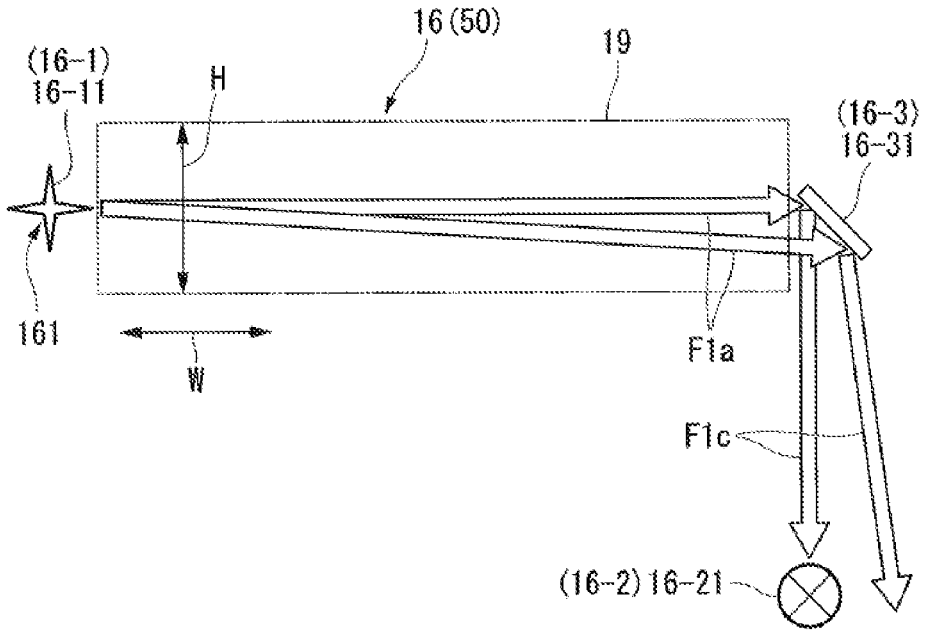
FIG. 8 is an explanatory diagram illustrating a first action of a sensor transmitter, a reflector, and a sensor receiver of an object detection apparatus according to an embodiment.
Figure 9:
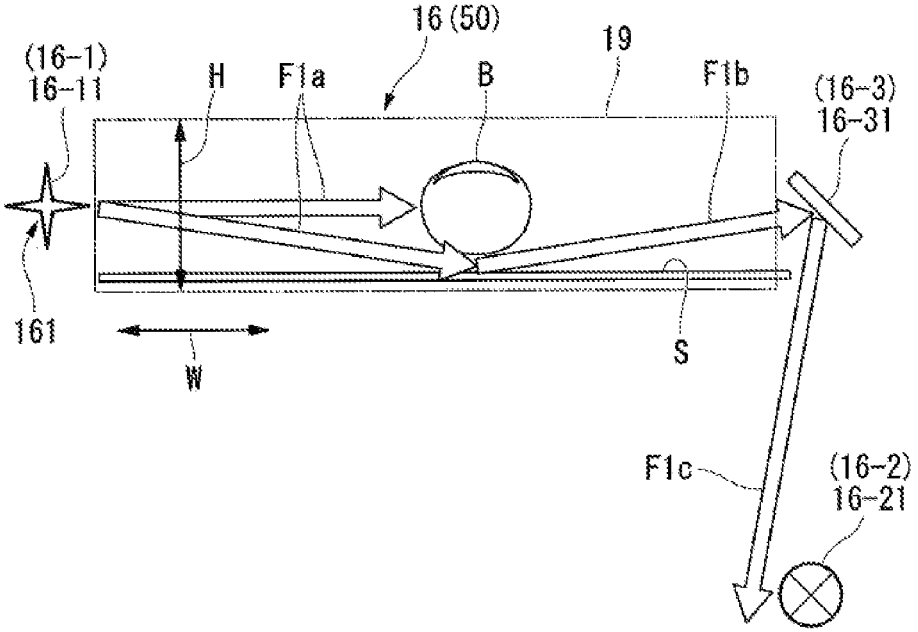
FIG. 9 is an explanatory diagram illustrating a second action of a sensor transmitter, a reflector, and a sensor receiver of an object detection apparatus according to an embodiment.

FIG. 7 is a perspective view illustrating an arrangement of the sensor transmitter 16-1, the reflector 16-3, and the sensor receiver 16-2 of the object detection apparatus 50 according to the embodiment. FIG. 8 is an explanatory diagram illustrating a first action of the sensor transmitter 16-1, the reflector 16-3, and the sensor receiver 16-2 of the object detection apparatus 50 according to the embodiment. FIG. 9 is an explanatory diagram illustrating a second action of the sensor transmitter 16-1, the reflector 16-3, and the sensor receiver 16-2 of the object detection apparatus 50 according to the embodiment.

As illustrated in FIG. 7, the object detection apparatus according to the embodiment has the following configuration as a sensor 16 for detecting an object (foreign object) B entering the apparatus from the discharge port 19. The sensor 16 includes a sensor transmitter 16-1 that irradiates the width direction path F1, F2 extending in the width direction W with light in the discharge port 19, a reflector (mirror) 16-3 that reflects a light that has passed through the width direction paths F1 and F2 to the reflection paths R1 and R2, and a sensor receiver 16-2 that receives the light reflected by a reflection portion.

In an embodiment, the object detection apparatus 50 includes a pair of sensors 161 and 162. Hereinafter, the pair of sensors 161 and 162 are referred to as a first sensor 161 and a second sensor 162.

Each sensor 161 and 162 includes an sensor transmitter 16-1 that emits light such as infrared rays and a sensor receiver 16-2 that receives the light emitted by the sensor transmitter 16-1. A reflector 16-3 is provided between the sensor transmitter 16-1 and the sensor receiver 16-2. The sensor transmitter 16-1 may be referred to as a light source, an emitter, an emitting unit, or the like. The sensor receiver 16-2 may be referred to as light receiver unit or a light sensor.

Each sensor receiver 16-2 includes a first sensor receiver 16-21 and a second sensor receiver 16-22 having different optical path lengths from the respective sensor transmitters 16-1. In the embodiment shown in FIG. 7, each sensor transmitter 16-1 includes a first transmitter 16-11 and a second transmitter 16-12.

The sensor transmitter 16-1 and the sensor receiver 16-2 of the sensor 16 operate in conjunction with each other to detect an object B of the discharge port 19. The sensor transmitter 16-1 includes a light-emitting element that is a light source such as a light emitting diode (LED). The sensor receiver 16-2 includes a light receiving element that receives the electromagnetic wave emitted by the sensor transmitter 16-1. The sensor receiver 16-2 outputs information (hereinafter referred to as "sensor information") to the post-processing controller 15 indicating whether or not the object B has been detected within a detection range covering the relevant space of the post-processing apparatus 3. The detection range in this context is the space in which the electromagnetic waves radiated by the sensor transmitter 16-1 propagate. That is, the detection range is a space in which the object B can be detected by the sensor transmitter 16-1 and the sensor receiver 16-2 operating in conjunction with each other.

The sensor receiver 16-2 detects the object B based on a reception of the electromagnetic waves transmitted by the sensor transmitter 16-1. If a reception satisfies a predetermined condition (hereinafter referred to as a "detection condition"), the sensor receiver 16-2 indicates a detection of the object B in the detection range. The sensor receiver 16-2 may output the sensor information indicating that the object B has been detected for any reception state. For example, the sensor information may indicate that the object B has been detected when the sensor receiver 16-2 does not receive the electromagnetic wave transmitted by the sensor transmitter 16-1. For example, the sensor information may indicate that the object B has been detected when an light intensity received by the sensor receiver 16-2 is equal to or less than some predetermined intensity.

Note that the sensor 16 is not limited to the transmission type sensor and, in general, as long as the sensor 16 is capable of detecting the object B in some predetermined detection range cover the space above the processing tray 18 and the space in the discharge port 19, any sensor type may be adopted.

The sensor 16 may be disposed at any position satisfying a transmission unit condition and a reception unit condition. The transmission unit condition is a condition that the sensor transmitter 16-1 is arranged at a position capable of radiating an electromagnetic wave along the sheet surface direction in the relevant detection range. The reception unit condition is that the sensor receiver 16-2 is arranged at a position where the electromagnetic wave radiated by the sensor transmitter 16-1 can be received.

For example, when the height (vertical width) of the discharge port 19 is denoted by V1, the sensor transmitter 16-1 and the sensor receiver 16-2 may be arranged at a position V2 where the height from the lower end of the discharge port 19 is lower than V1. For example, since an average thickness of a child's hand is 20 mm, V2 may be 15 mm. When V2 is 15 mm, the sensor 16 can detect a hand of a child inserted in the detection range. On the other hand, when V2 is 15 mm, the image forming system 1 does not detect the sheets S or the sheet bundles SS that are thinner than 15 mm.

When the sensor 16 detects the object B having a thickness greater than or equal to the predetermined value at the determination timing, the post-processing apparatus 3 determines that the object B is present in the post-processing space and makes an emergency stop. This prevents the post-processing from being performed in a state in which the object B is in the post-processing space.

As described above, the post-processing apparatus 3 makes an emergency stop if the object which has a thickness greater than some predetermined thickness (hereinafter, referred to as a "reference thickness") is in the post-processing space. The "thickness" refers to a thickness in a deposition direction of a sheet S on a processing tray. The "predetermined thickness" is a thickness corresponding to a position (e.g., a position in the detection range) through which the electromagnetic wave from the sensor transmitter 16-1 propagates normally. That is, the "predetermined thickness" is a distance corresponding to the height from the processing tray 18 to a position through which the electromagnetic waves pass through. For example, when the electromagnetic wave radiated by the sensor transmitter 16-1 propagates through the position where the height from the processing tray 18 is V2, the "predetermined thickness" is V2. That is, the detection range of the sensor 16 is a space in which the distance from the processing tray 18 is at a distance equal to or more than a predetermined distance V2. The detection range includes the space above the processing tray (post-processing space) and the space in the discharge port 19 adjacent to the downstream side of the processing tray.

The post-processing controller 15 determines whether or not the sensor 16 detects the object B at a predetermined timing (hereinafter referred to as a "determination timing") on the basis of the sensor information. If it is possible to determine whether or not the sensor 16 has detected the object B at the determination timing based on the sensor information, the post-processing controller 15 may determine whether or not the detection sensor 16 has detected the object B at the determination timing based on the sensor information in any way. The determination timing may be any timing as long as it is before execution of the post-processing and the possibility that the sensor 16 detects the sheet bundle SS is lower than some predetermined value.

The determination timing is a timing other than the timing at which the sheet bundle SS passes through the path on which the electromagnetic wave radiated by the sensor transmitter 16-1 propagates. The determination timing may be any timing as long as it is a timing other than the timing at which the sheet bundle SS passes through the path. For example, the determination timing may be after the pinch roller 47 has been lowered. For example, the determination timing may be after the matching processing is completed. For example, the determination timing may be after a drop processing is completed. For example, the determination timing may be a timing at which the sheet bundle SS is transported to the processing tray 18. When the determination timing is after the end of the drop processing or after the end of the matching processing, the possibility that the sensor 16 detects the falling sheet S becomes low. For example, the post-processing controller 15 may cause the sensor 16 to operate only at determination times.

As shown in FIG. 7, a first reflector 16-31 and a second reflector 16-32 are disposed in the optical paths from the sensor transmitters 16-11 and 16-12 to the respective sensor receivers 16-21 and 16-22, respectively.

The reflectors 16-31 and 16-32 extend the optical path length of each sensor 161 and 162 by reflecting the optical path at a position avoiding the discharge port 19. For example, the optical path lengths of the respective sensors 161 and 162 are different from each other.

The arrows F1 and F2 in the figure indicate light beams emitted from the sensor transmitters 16-11 and 16-12 of the sensors 161 and 162. Line segments L1 and L2 of the arrows F1 and F2 indicate the center line of the width direction path (detection areas) extending in the width direction W in the discharge port 19. The length of the line segment L1 indicates the length of the optical path from the sensor transmitter 16-11 of the first sensor 161 to the reflector 16-31. The length of the line segment L2 indicates the length of the optical path from the sensor transmitter 16-12 of the second sensor 162 to the reflector 16-32.

The arrows F3 and F4 in the figure indicate reflected light reflected from the reflectors 16-31 and 16-32 to the sensor receivers 16-21 and 16-22 respectively. The reflection lights F3 and F4 are reflected toward reflection paths R1 and R2 extending downward from both sides of the discharge port 19 in the width direction W. The reflection paths R1 and R2 are provided using dead space on the side wall inside the housing of the post-processing apparatus 3. The length of the line segment L3 of the arrow F3 indicates the length of the optical path from the reflectors 16-31 of the first sensor 161 to the sensor receiver 16-21. The length of the line segment L4 of the arrow F4 indicates the length of the optical path from the reflective portion 16-32 of the second sensor 162 to the sensor receiver 16-22.

The optical path lengths L3 and L4 are different from each other, and the respective optical path lengths from the sensor transmitters 16-11 and 16-12 to the sensor receivers 16-21 and 16-22 are thus made different from each other. Note that, although the optical path length L1 and the optical path length L2 are depicted as approximately the same as each other in the illustrated example in the drawings, these optical path lengths may be different from each other in length.

In the present embodiment, the sensor transmitter 16-11 and 16-12 and the reflector 16-31 and 16-32 are disposed on both sides of the discharge port 19 in the width direction W to cover the appropriate detection range around the discharge port 19. The sensor receivers 16-21 and 16-22 are disposed at positions avoiding the discharge port 19 in the vertical direction H orthogonal to the width direction W. The sensor transmitters 16-11 and 16-12 emit light along width direction paths F1 and F2 extending in the width direction W in the discharge port 19. The mirrors that are the reflectors 16-31 and 16-32 reflect the light that has passed through the width direction path F1 and F2 toward the sensor receivers 16-21 and 16-22, respectively. In other words, the reflectors 16-31 and 16-32 reflect the light toward the reflection paths R1 and R2 avoiding the width direction path F1 and F2. The light reflected by the reflecting portion is denoted by a reference sign F1*c* (reflected light F1*c*) in the figure. The sensor receivers 16-21 and 16-22 are capable of receiving the reflected light F1*c* after the reflected light F1*c* passes through the reflection paths R1 and R2. When the reception intensity of the reflected light F1*c* is equal to or less than the predetermined intensity, the sensor receivers 16-21 and 16-22 detect that the object B is present in the space within the detection range.

The sensor receivers 16-21 and 16-22 detect the presence or absence of the object (foreign object) B at the discharge port 19 based on whether or not detection light (reflected light) emitted by the sensor transmitter 16-11 and 16-12 is detected at a predetermined amount or more than a predetermined amount of detection light (reflected light). When the sensor 16 detects the object B, it is possible to perform a corresponding operation such as stopping the processing of the apparatus.

When the reflectors 16-31 and 16-32 reflect the detection light along the width direction paths F1 and F2, the sensor 16 may not detect the object B of the discharge port 19 as in the above-described comparative example.

The detection light emitted from the sensor transmitters 16-11 and 16-12 includes a direct light F1*a* passing through the discharge port 19 along the width direction paths F1 and F2, and a reflected light F1*b* reflected by the sheet at the discharge port 19. If the reflected light F1*b* passes through the discharge port 19, the sensor 16 does not detect the object B even if the object B in the discharge port 19 blocks the direct light F1*a* along the width direction path F1 and F2. That is, even if the object B is present in the discharge port 19, the sensor 16 may not detect the object B in some cases.

In the embodiment, the light that has passed through the width direction path F1 and F2 is reflected toward the reflection paths R1 and R2 that avoid the width direction path F1 and F2, and thus the following effects are obtained. That is, it is possible to detect the object B in any one of the width direction paths F1 and F2 and the reflection paths R1 and R2, which are all different from each other, and it is possible to suppress erroneous detection. When the reflectors 16-31 and 16-32 reflect the detection light along the width direction paths F1 and F2, the detection light may be reflected by the sheet S under the same conditions. In this case, there is a possibility that the light will pass through the discharge port 19 while avoiding the object B in both the reciprocating directions. On the other hand, by having the width direction path F1 and F2 and the reflection path R1 and the reflection path R2, which are different from each other, it is possible to prevent the light from being reflected by the sheet S in the reciprocating direction in the same condition. This makes it possible to suppress the occurrence of erroneous detection due to reflected light on the sheet S, and detect the object B of the discharge port 19 with high accuracy.

In the embodiment, the sensor transmitters 16-11 and 16-12 are arranged on one side in the width direction W of the discharge port 19, and the reflectors 16-31 and 16-32 are arranged on the other side of the discharge port 19 in the width direction W. The sensor receivers 16-21 and 16-22 are arranged so as to avoid the discharge port 19 in the vertical direction H that intersects with the width direction W. According to this configuration, the reflected light Fib on the sheet S has the following effects because the incident angles on the reflectors 16-31 and 16-32 are different from the direct light F1*a* from the sensor transmitters 16-11 and 16-12. The reflected light Fib on the sheet S may be set to have a configuration that does not reach the sensor receivers 16-21 and 16-22 after reflection by the reflectors 16-31 and 16-32.

Therefore, it is possible only the direct light F1*a* from the sensor transmitters 16-11 and 16-12 reaches the sensor receiver 16-21 and 16-22 after the reflection by the reflectors 16-31 and 16-32. Therefore, the influence of the reflected light Fib on the sheet S can be suppressed, and the object B at the discharge port 19 can be detected with high accuracy. Further, the optical path length is increased in the direction intersecting with the width direction W, and the reflected light is less likely to reach the sensor receivers 16-21 and

16-22. This makes it possible to suppress an increase in the size of the object detection apparatus 50.

When two or more sensor receivers 16-21 and 16-22 and two or more sensor transmitters 16-11 and 16-12 are used, the sensor transmitters 16-11 and 16-12 and the reflectors 16-31 and 16-32 are disposed across a detection target range in the width direction W in the discharge port 19. Further, the sensor receiver 16-21 and 16-22 is disposed outside the detection target range. Accordingly, the reflected light Fib reflected by the sheet S in the detection target range is prevented from reaching the sensor receivers 16-21 and 16-22. With this, it is possible to detect the influence of the reflected light Fib on the sheet S, and it is possible to detect the foreign object with a plurality of conditions having different detection characteristics. Then, when the foreign matter is detected under even one condition, the apparatus can be immediately stopped.

In the embodiment, the sensor 16 includes a plurality of sensor transmitters 16-11 and 16-12, a plurality of reflectors 16-31 and 16-32, and a plurality of sensor receivers 16-21 and 16-22. The plurality of sensor transmitters 16-11 and 16-12 include a first sensor transmitter 16-11 disposed on a first side of the discharge port 19, and a second sensor transmitter 16-12 disposed on a second side of the discharge port 19 opposite the first side in the width direction W. The plurality of reflectors 16-31 and 16-32 are both disposed on the second side of the discharge port 19. The first reflector 16-31 reflects the light emitted by the first sensor transmitter 16-11, and a second reflector 16-32 reflects the light radiated by the second sensor transmitter 16-12. The plurality of sensor receivers 16-21 and 16-22 are disposed so as to not overlap the discharge port 19 in any direction perpendicular to the width direction W. A first sensor receiver 16-21 receives the light reflected by the first reflector 16-31, and a second sensor receiver 16-22 receives the light reflected by the second reflector 16-32.

According to this configuration, the plurality of sensor transmitters 16-11 and 16-12 and the plurality of reflectors 16-31 and 16-32 are distributed on both sides of the discharge port 19. The plurality of sensor receivers 16-21 and 16-22 are disposed at positions not overlapping with the discharge port 19. The reflection light Fib on the sheet S has an effect similar to that described above because the incident angles on the reflectors 16-31 and 16-32 are different from the direct light from the sensor transmitters 16-11 and 16-12. That is, it is possible to suppress the influence of the reflected light Fib on the sheet S, and to detect the object B of the discharge port 19 with high accuracy. Further, it is possible to increase the optical path length in the direction intersecting the width direction W, and it is possible to suppress an increase in size of the object detection apparatus 50.

Further, by providing the plurality of sensor transmitters 16-1 and sensor receiver 16-2, a redundancy for failure of any one of the sensor transmitter 16-1 and the sensor receiver 16-2 can be achieved.

In an embodiment, the length L3 of the reflection path R1 from the first reflector 16-31 to the first sensor receiver 16-21 is different from the length L4 of the reflection path R2 from the second reflector 16-32 to the second sensor receiver 16-22.

According to this configuration, it is possible to detect the object B under a plurality of conditions having different detection characteristics, and it is possible to suppress erroneous detection even in a state in which the reflected light F1*b* on the sheet S is generated.

Figure 10:
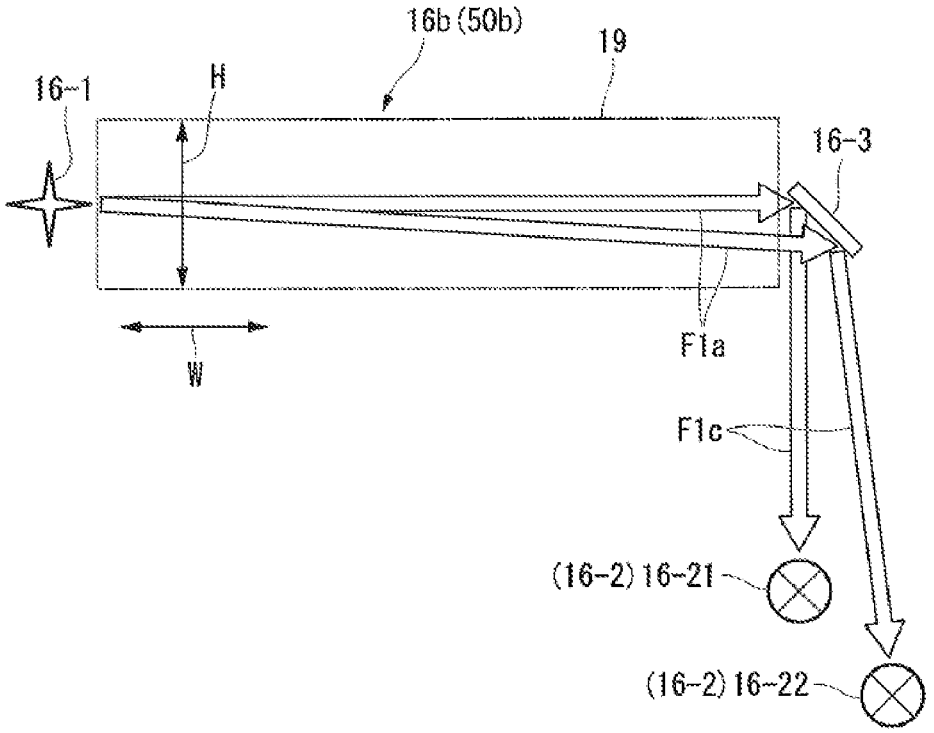
FIG. 10 depicts a first modification example of an object detection apparatus according to an embodiment.

FIG. 10 illustrates a first modification (reference numeral 50*b*) of the object detection apparatus 50 according to the embodiment.

The sensor 16*b* of the object detection apparatus 50*b* illustrated in FIG. 10 includes one sensor transmitter 16-1 and two sensor receivers 16-21 and 16-22. A reflector 16-3 is provided in the optical path between the sensor transmitter 16-1 and the two sensor receivers 16-21 and 16-22.

In this case, the sensor receivers 16-21 and 16-22, the sensor transmitter 16-1, and the reflector 16-3 are positioned such that the optical path lengths from the sensor transmitter 16-1 to each of the sensor receivers 16-21 and 16-22 are different. With this, it is possible to detect the influence of the reflected light Fib on the sheet S, and it is possible to detect the foreign object with a plurality of conditions having different detection characteristics. Then, when the foreign matter is detected under any one of the conditions, the apparatus can be immediately stopped.

That is, in the first modification, the sensor 16*b* includes a single sensor transmitter 16-1 but a plurality of sensor receivers 16-21 and 16-22, and the plurality of sensor receivers 16-21 and 16-22 include at least a first sensor receiver 16-21 and a second sensor receiver 16-22 having different lengths L3 and L4 of reflection paths R1 and R2 from the reflector 16-3.

According to this configuration, since the lengths L3 and L4 of the reflection paths R1 and R2 are different from each other, it is possible to detect the object B under a plurality of conditions having different detection characteristics. This makes it possible to suppress erroneous detection even in a situation in which the reflected light Fib on the sheet S is generated, and to achieve redundancy against failures of the sensor receiver 16-21 and 16-22.

Figure 11:
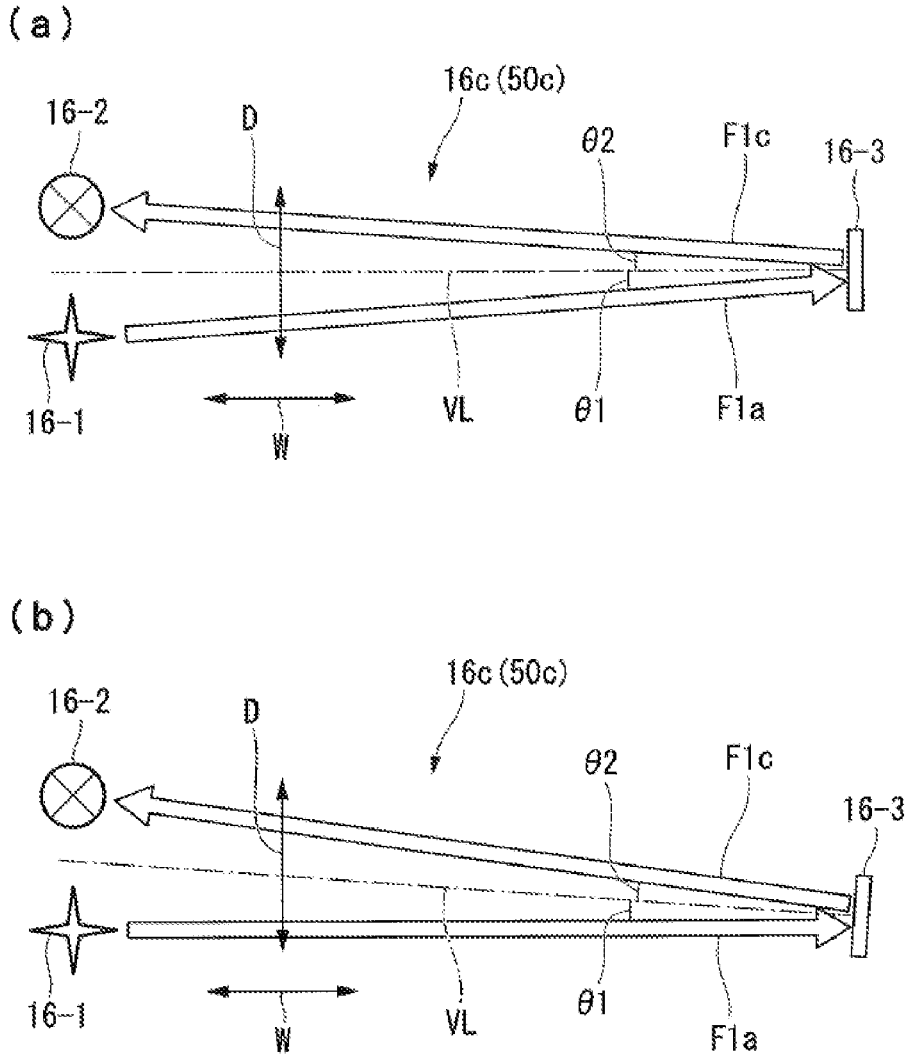
FIG. 11 depicts a second modification example of an object detection apparatus of an embodiment.

FIG. 11 illustrates a second modified example (reference numeral 50*c*) of the object detection apparatus 50 according to the embodiment.

Figure 12:
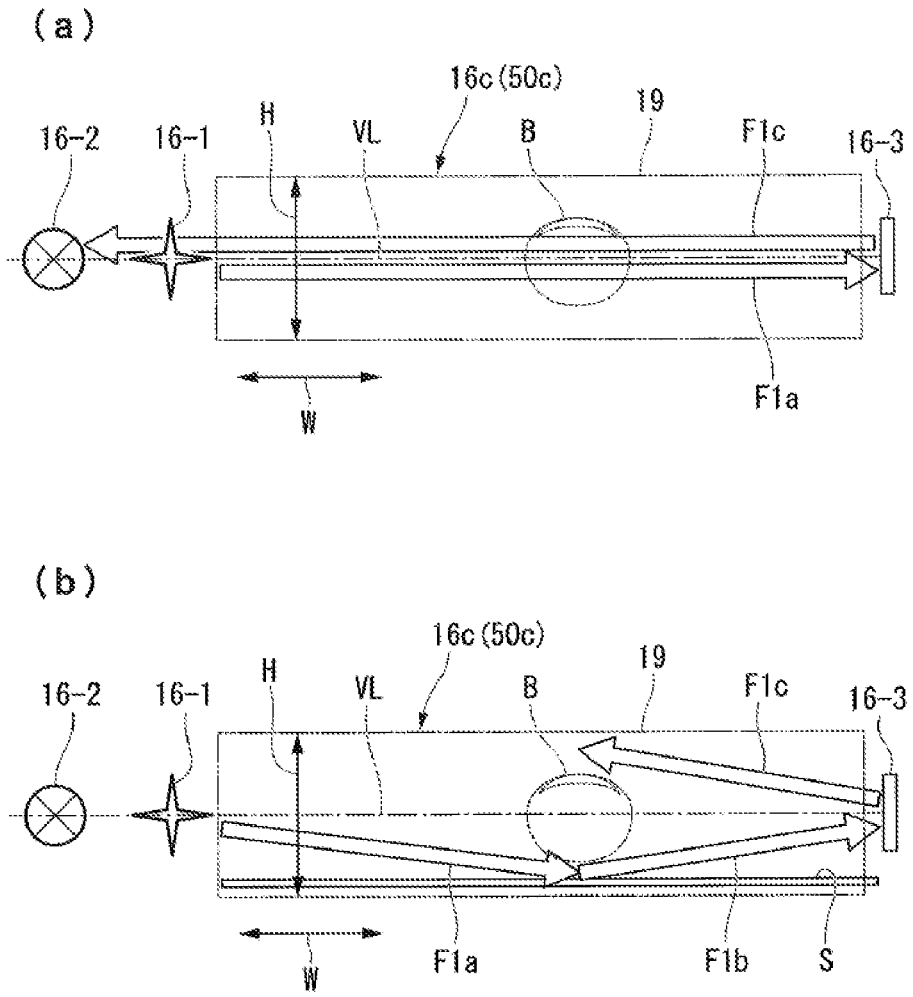
FIG. 12 depicts aspects of a first action (a) and a second action (b) in a second modification example of an object detection apparatus of the embodiment.

The sensor 16*c* of the object detection apparatus 50*c* illustrated in FIGS. 11 and 12 includes a sensor transmitter 16-1, a sensor receiver 16-2, and a reflector 16-3, respectively. The sensor transmitter 16-1 and the sensor receiver 16-2 are disposed on the same side, in the width direction W, of the discharge port 19, and the reflector 16-3 is disposed on the other (opposite) side of the discharge port 19 in the width direction W.

In other words, the sensor transmitter 16-1 and the sensor receiver 16-2 are on the same side in the width direction W, and the reflector 16-3 is on the other side in the width direction W. The sensor transmitter 16-1 and the sensor receiver 16-2 are disposed so as to be spaced apart in the depth direction (sheet conveyance direction) (see FIG. 11).

As shown in FIGS. 11(*a*) and 12(*a*), the light (direct light F1*a*) entering the reflector 16-3 from the angle θ1 with respect to the perpendicular direction is returned to the sensor receiver 16-2 at the angle θ2 with respect to the right angle (reflected light F1*c*), by utilizing the properties of the angle of incidence and the reflection angle of the reflecting portion 16-3. The line VL in the drawing indicates an extension line perpendicular to the reflection surface of the reflector 16-3.

Therefore, when the object B exists within the detection target range, any one of the direct light F1*a* emitted from the sensor transmitter 16-1 and the reflected light F1*c* reflected by the reflector 16-3 can be blocked by the object B. Therefore, the sensor receiver 16-2 does not return the light from the sensor transmitter 16-1, and the sensor 16*c* correctly recognizes that the object is present.

As shown in FIG. 12(*b*), even if the direct light F1*a* is reflected at a location other than the object B, and the reflected light Fb1 enters the reflector 16-3, the reflected light Fb1 is incident at a predetermined angle that is not a right angle with respect to the reflector 16-3, and therefore, the reflected light F1*c* reflected by the reflector 16-3 does not travel toward the sensor receiver 16-2, and is attenuated or diverged. According to this configuration, the reflector 16-3 reflects the light. Therefore, even in the case of light reflected at any location in the discharge port 19 and not blocked by the object B, the light other than the light reflected by the reflector 16-3 can be set to not return to the sensor receiver 16-2. Accordingly, it is possible to detect the object B at the discharge port 19 with high accuracy.

In FIG. 12, for convenience of description, the sensor transmitter 16-1 and the sensor receiver 16-2 are disposed separated from each other in the width direction W, but the sensor transmitter 16-1 and the sensor receiver 16-2 may be disposed in close proximity to each other.

Here, since the incident angle θ1 (the angle with respect to the extension line VL) when light enters the reflector 16-3 from the sensor transmitter 16-1 and the reflection angle θ2 (the angle with respect to the extension line VL) of the light reflected by the reflector 16-3 are equal to each other, the sensor receiver 16-2 is required to be disposed on the optical path of the reflected light F1*c*. That is, as described above, if the sensor receiver 16-2 can be disposed, for example, as illustrated in FIG. 11(*b*), the reflective surface of the reflector 16-3 may be disposed so as to incline with respect to the depth direction D. At this time, the extension line VL also inclines with respect to the width direction W.

In addition, in the above-described modification, the sensor transmitter 16-1 and the sensor receiver 16-2 are separated in the depth direction D, but may instead, or in addition, be spaced apart from each other in the up-down direction H. Further, if the angle of the reflector 16-3 is appropriately adjusted, it may be arranged at a three dimensionally spaced position separated in each of the width direction W, the vertical direction H, and the depth direction. In this way, the arrangement of the sensor transmitter 16-1, the sensor receiver 16-2, and the reflector 16-3 has a high degree of freedom.

Figure 13:
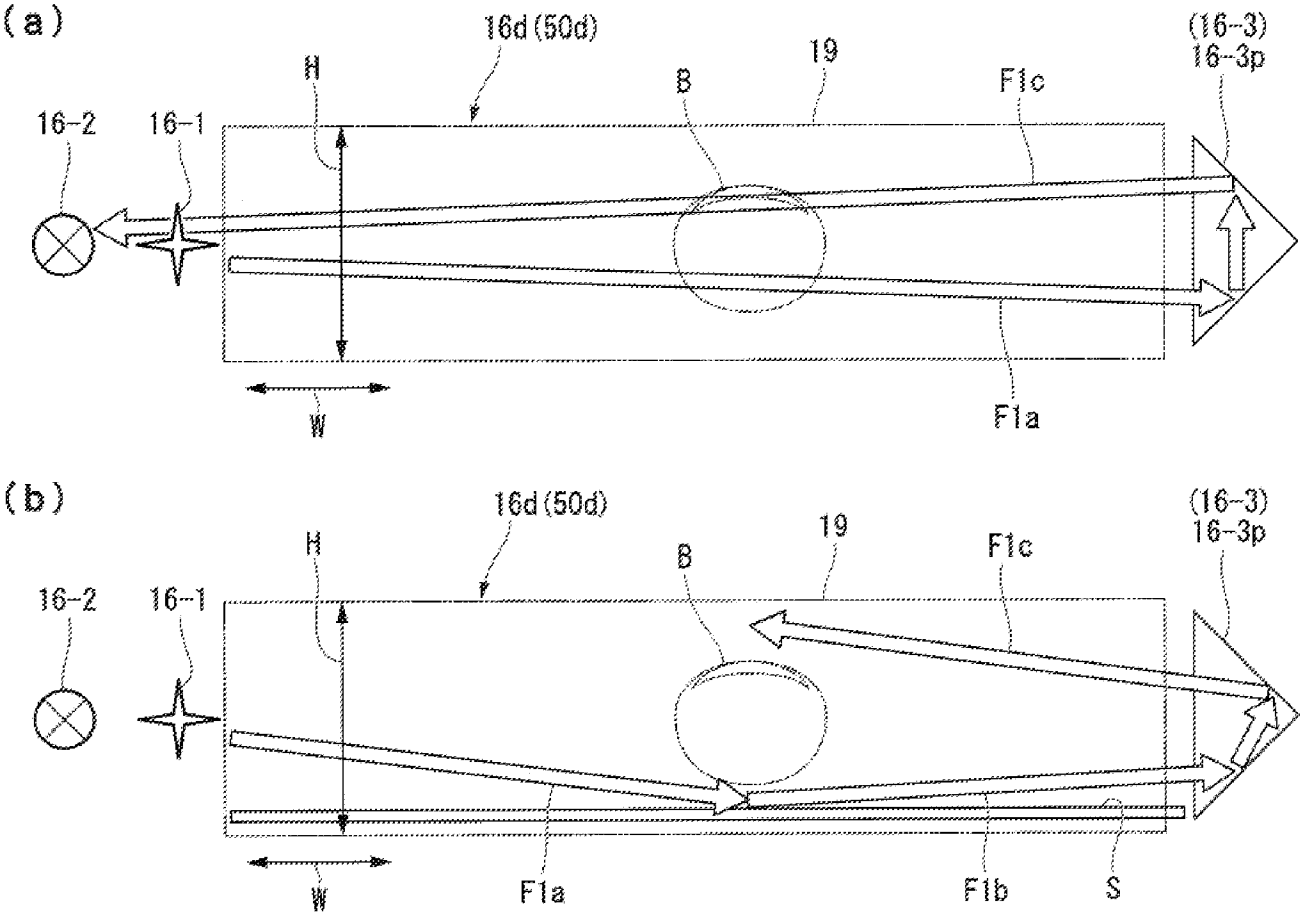
FIG. 13 depicts aspects of first action (a) and a second action (b) in a third modification example of an object detection apparatus of an embodiment.

FIG. 13 illustrates a third modified example of the object detection apparatus 50 according to the embodiment. The sensor 16*d* of an object detection apparatus 50*d* illustrated in FIG. 13 is different from the sensor 16*c* of the second modification in that the reflector 16-3 is a prism 16-3*p*. The sensor transmitter 16-1 and the sensor receiver 16-2 are disposed in one side of the discharge port 19, and the prism 16-3*p* (reflection portion 16-3) is disposed in the other side of the discharge port 19 in the width direction W. Then, as shown in FIG. 13(*a*), the light entering from an irradiation direction substantially orthogonal to the prism 16-3*p* (direct light F1*a*) is reflected in the prism 16-3*p* and returns to the sensor receiver 16-2 from the reflection direction at a substantially right angle, by utilizing the properties of the incident angle and the reflection angle of the prism 16-3*p*. Therefore, when the object B is present in the detection target range, either the direct light F1*a* emitted from the sensor transmitter 16-1 or the reflected light F1*c* reflected by the prism 16-3*p* thereafter is blocked by the object B. Therefore, the light from the sensor transmitter 16-1 does not return to the sensor receiver 16-2, and the sensor 16*d* correctly recognizes that the object is present.

As shown in FIG. 13(*b*), even if the direct light F1*a* is reflected at a location other than the object B, and the reflected light Fb1 enters the prism 16-3*p*, the reflected light Fb1 enters the prism 16-3*p* at a predetermined angle with respect to the irradiation direction, and therefore the reflected light F1*c* reflected by the prism 16-3*p* does not travel toward the sensor receiver 16-2 and is attenuated or diverged.

According to this configuration, since the light is reflected by the prism 16-3*p*, even when the light is reflected at any location in the discharge port 19 and is not blocked by the object B, the light other than the light entering the prism 16-3*p* in the prescribed direction can be set so as not to return to the sensor receiver 16-2. Accordingly, it is possible to detect the object B of the discharge port 19 with high accuracy.

As described above, in the object detection apparatus 50 according to the second modified example and the third modified example, the arrangement of the sensor transmitter 16-1, the sensor receiver 16-2, and the reflector 16-3 can be compactly accommodated.

In the above-described embodiment, the post-processing apparatus 3 is separate from the image forming apparatus 2. However, the post-processing apparatus 3 may be an image forming apparatus having an in-body finisher in a main housing of the image forming apparatus 2 and relevant aspects of post-processing apparatus 3 can be applied to such an in-body finisher. The post-processing apparatus 3 includes a stapler as a sheet binding processing unit. However, the post-processing apparatus 3 may also or instead include a sheet binding processing unit using an adhesive tape.

According to at least one embodiment described above, the sensor 16 of the object detection apparatus 50 of the post-processing apparatus 3 includes the sensor transmitter 16-1, the reflector 16-3, and the sensor receiver 16-2, thereby suppressing the occurrence of erroneous detection due to the reflected light reflected by the sheet S, and detecting the object B of the discharge port 19 with high accuracy.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed:

1. A post-processing apparatus, comprising:

a post-processing unit configured to receive sheets from an image forming apparatus, perform processing on the received sheets, and then discharge the processed sheets through a discharge port;

a sensor configured to detect a presence of an object at the discharge port, the sensor comprising:

a first light emitter on a first side of the discharge port and positioned to emit a light across a width of the discharge port, a reflector on a second side of the discharge port opposite the first side in a first direction, and a first light receiver positioned to receive light of the first light emitter from the reflector; and a controller configured to terminate the processing on the received sheets by the post-processing unit when the sensor detects the presence of the object at the discharge port, wherein the first light receiver is on the second side of the discharge port.

2. The post-processing apparatus according to claim 1, wherein the reflector is a mirror.

3. The post-processing apparatus according to claim 1, wherein the reflector is a prism.

4. The post-processing apparatus according to claim 1, further comprising:

a second light receiver positioned to receive light of the first light emitter from the reflector.

5. The post-processing apparatus according to claim 4, wherein the second light receiver is on the second side of the discharge port.

6. The post-processing apparatus according to claim 5, wherein the first and second light receivers are positioned not to overlap any portion of the discharge port.

7. The post-processing apparatus according to claim 1, wherein the first light receiver is positioned not to overlap any portion of the discharge port.

8. The post-processing apparatus according to claim 1, wherein the post-processing unit is a stapler.

9. The post-processing apparatus according to claim 1, further comprising:

a discharge tray below the discharge port, the discharge tray positioned to hold sheets discharged through the discharge port.

10. An image forming apparatus, comprising:

a main housing;

an image forming unit in the main housing and configured to print images on sheets; and a post-processing apparatus according to claim 1, wherein the post-processing apparatus is inside the main housing.

11. An image forming apparatus, comprising:

a main housing with a sheet outlet port;

an image forming unit in the main housing and configured to print images on sheets and discharge printed sheets through the sheet outlet port;

a post-processing apparatus according to claim 1, wherein the post-processing apparatus is outside the main housing and positioned to receive the discharged printed sheets from the sheet outlet port.

12. A post-processing apparatus, comprising:

a post-processing unit configured to receive sheets from an image forming apparatus, perform processing on the received sheets, and then discharge the processed sheets through a discharge port;

a sensor configured to detect a presence of an object at the discharge port, the sensor comprising:

a first light emitter on a first side of the discharge port and positioned to emit a light across a width of the discharge port, a reflector on a second side of the discharge port opposite the first side in a first direction, and a first light receiver positioned to receive light of the first light emitter from the reflector;

a controller configured to terminate the processing on the received sheets by the post-processing unit when the sensor detects the presence of the object at the discharge port; and a second light receiver positioned to receive light of the first light emitter from the reflector.

13. The post-processing apparatus according to claim 12, wherein the first and second light receivers are on the second side of the discharge port.

14. The post-processing apparatus according to claim 13, wherein the first and second light receivers are positioned not to overlap any portion of the discharge port.

15. The post-processing apparatus according to claim 12, wherein the post-processing unit is a stapler.

16. The post-processing apparatus according to claim 12, further comprising:

a discharge tray below the discharge port, the discharge tray positioned to hold sheets discharged through the discharge port.

17. An image forming apparatus, comprising:

a main housing;

an image forming unit in the main housing and configured to print images on sheets; and a post-processing apparatus according to claim 12, wherein the post-processing apparatus is inside the main housing.

18. An image forming apparatus, comprising:

a main housing with a sheet outlet port;

an image forming unit in the main housing and configured to print images on sheets and discharge printed sheets through the sheet outlet port;

a post-processing apparatus according to claim 12, wherein the post-processing apparatus is outside the main housing and positioned to receive the discharged printed sheets from the sheet outlet port.

* * * * *